US006889854B2

(12) United States Patent
Burke

(10) Patent No.: US 6,889,854 B2
(45) Date of Patent: May 10, 2005

(54) SNAP-FIT ADJUSTABLE DISPLAY SYSTEM

(75) Inventor: Robert P. Burke, Dana Point, CA (US)

(73) Assignee: Burke Display Systems, Inc., Dana Point, CA (US)

( * ) Notice: Subject to any disclaimer, the term of this patent is extended or adjusted under 35 U.S.C. 154(b) by 0 days.

(21) Appl. No.: 10/096,223

(22) Filed: Mar. 11, 2002

(65) Prior Publication Data

US 2002/0088762 A1 Jul. 11, 2002

Related U.S. Application Data

(63) Continuation-in-part of application No. 09/379,704, filed on Aug. 24, 1999.

(51) Int. Cl.[7] ..... A47F 7/00
(52) U.S. Cl. ..... 211/59.3
(58) Field of Search ..... 211/59.3, 59.2, 211/59.4, 184; 342/71, 61, 63

(56) References Cited

U.S. PATENT DOCUMENTS

| | | | | |
|---|---|---|---|---|
| 2,110,299 A | | 3/1938 | Hinkle | |
| 2,652,154 A | | 9/1953 | Stevens | |
| 2,934,212 A | | 4/1960 | Jacobson | |
| 3,161,295 A | | 12/1964 | Chesley | |
| 3,308,961 A | | 3/1967 | Chesley | |
| 3,830,169 A | * | 8/1974 | Madey | 108/61 |
| D256,301 S | | 8/1980 | Cutts | |
| 4,300,693 A | | 11/1981 | Spamer | |
| 4,303,162 A | | 12/1981 | Suttles | |
| 4,504,100 A | | 3/1985 | Chaumard | |
| 4,724,968 A | | 2/1988 | Wombacher | |
| 4,729,481 A | * | 3/1988 | Hawkinson et al. | 211/59.3 |
| 4,730,741 A | | 3/1988 | Jackle, III et al. | |
| 4,762,236 A | | 8/1988 | Jackle, III et al. | |
| 4,821,894 A | | 4/1989 | Dechirot | |
| D300,994 S | | 5/1989 | Wolff | |

(Continued)

OTHER PUBLICATIONS

VP–2 Assembly Instructions (Level 1), Space Management Systems, Inc., Oct. 1990.

*Primary Examiner*—Hugh B. Thompson, II
*Assistant Examiner*—Sarah Purol
(74) *Attorney, Agent, or Firm*—Knobbe, Martens, Olson & Bear, LLP

(57) ABSTRACT

An adjustable snap-fit display assembly is used in a product display assembly. The display assembly stores and displays products of a variety of shapes and sizes and automatically delivers the products to the front of the display assembly. The adjustable display assembly includes a frame and a product supporting and feeding assembly. The product supporting and feeding assembly has tracks and, in some instances, dividers. The product tracks and dividers can be separately formed or integrated into a single component. The tracks and/or dividers are considered insertable components that can be added or removed as needed and that can be separated by varying distances depending on the width of product to be displayed. The insertable components generally are freely slideable and are snap-fit onto the frame. The product supporting and feeding assembly allows product to be fed forward to a front fence such that all or almost all of the available shelf depth can be used.

6 Claims, 8 Drawing Sheets

U.S. PATENT DOCUMENTS 4,830,201 A 5/1989 Breslow
4,836,390 A 6/1989 Polvere
4,898,282 A 2/1990 Hawkinson et al.
4,899,893 A 2/1990 Robertson
4,901,869 A 2/1990 Hawkinson et al.
4,907,707 A 3/1990 Crum
5,012,936 A 5/1991 Crum
5,027,957 A * 7/1991 Skalski ..... 211/59.3
D318,769 S 8/1991 Marchiony et al.
5,069,349 A 12/1991 Wear et al.
5,082,125 A * 1/1992 Ninni ..... 211/184
5,085,154 A * 2/1992 Merl ..... 108/90
5,088,607 A * 2/1992 Risafi et al. ..... 211/59.3
5,111,942 A 5/1992 Bernardin
5,123,546 A 6/1992 Crum
5,190,186 A 3/1993 Yablans et al.
5,203,463 A 4/1993 Gold
5,240,126 A 8/1993 Foster et al.
5,265,738 A 11/1993 Yablans et al.
5,341,945 A * 8/1994 Gibson ..... 211/184
5,353,939 A 10/1994 Beeler et al.
5,366,033 A 11/1994 Koivisto
5,366,099 A 11/1994 Schmid
5,390,802 A 2/1995 Pappagallo et al.
5,413,229 A 5/1995 Zuberbuhler et al.
5,450,968 A 9/1995 Bustos
5,450,969 A 9/1995 Johnson et al.
5,469,976 A 11/1995 Burchell
5,542,552 A 8/1996 Yablans et al.
5,562,217 A 10/1996 Salveson et al.
5,605,237 A 2/1997 Richardson et al.
5,613,621 A * 3/1997 Gervasi ..... 221/279
5,634,564 A 6/1997 Spamer et al.
5,638,963 A 6/1997 Finnelly et al.
5,665,304 A 9/1997 Heinen et al.
5,673,801 A 10/1997 Markson
5,685,664 A 11/1997 Parham et al.
5,746,328 A 5/1998 Beeler et al.
5,806,690 A 9/1998 Johnson et al.
5,839,588 A 11/1998 Hawkinson
5,855,281 A 1/1999 Rabas
5,855,283 A 1/1999 Johnson
5,873,489 A 2/1999 Ide et al.
5,878,895 A 3/1999 Springs
5,881,910 A 3/1999 Rein
5,992,652 A 11/1999 Springs
5,992,653 A 11/1999 Anderson et al.
6,041,720 A * 3/2000 Hardy ..... 108/60
6,082,557 A 7/2000 Leahy
6,105,791 A 8/2000 Chalson et al.
6,142,317 A 11/2000 Merl
6,155,438 A * 12/2000 Close ..... 211/59.3
6,227,385 B1 5/2001 Nickerson
6,234,328 B1 5/2001 Mason
D445,615 S 7/2001 Burke
6,357,606 B1 * 3/2002 Henry ..... 211/59.3
6,382,431 B1 * 5/2002 Burke ..... 211/59.3
6,484,891 B2 * 11/2002 Burke ..... 211/59.3
6,655,536 B2 * 12/2003 Jo et al. ..... 211/59.3
2002/0088762 A1 7/2002 Burke
2003/0010732 A1 1/2003 Burke

* cited by examiner

SNAP-FIT ADJUSTABLE DISPLAY SYSTEM

CROSS-REFERENCE TO RELATED APPLICATIONS

This application is a continuation-in-part of U.S. patent application Ser. No. 09/379,704, filed Aug. 24, 1999, which is hereby incorporated by reference in its entirety.

BACKGROUND OF THE INVENTION

1. Field of the Invention

The present invention generally relates to modular display systems that are capable of accommodating consumer products of various sizes through transverse sliding of components and snap-fit insertion or removal of components. More specifically, the present invention relates to an aesthetically pleasing construction of such a snap-fit adjustable display systems.

2. Description of Related Art

Shelving is used extensively for stocking and storing products or merchandise in a variety of stores. Most stores have immovable shelving which is arranged back-to-back between aisleways. The shelves commonly include dividing panels that are semi-permanently secured in position along the shelves through threaded fasteners or the like. Rotation of product supported on such permanent shelves and restocking such permanent shelves is an almost endless process. As is known, rotation of the products involves moving the older stock to the front of the shelf while positioning new stock behind the older stock.

One solution to such rotation and restocking problems involves providing forward-feeding shelving systems. One example of such a system is U.S. Pat. No. 5,111,942, issued on May 12, 1992 to Bernardin. As disclosed in that patent, a forward-biasing pusher member urges a group of articles forward within a casing that defines a merchandiser. The pusher is biased in a forward direction by a return spring that extends forward from the pusher, extends around a pulley and connects to a rear portion of the merchandiser in one arrangement. In another arrangement, a pair of pulleys is used on both sides of the pusher such that the return spring extends forward, then rearward and then forward again. In any event, the pusher feeds articles forward in the shelving to an abutment member, such that the articles are pinched between the abutment member and the pusher. Forward of the abutment member, in one arrangement, is an attachment construction. The attachment construction basically comprises an upwardly extending flange that can be secured to a base shelf, a slot on each of the merchandisers and a latch formed on each of the merchandisers along the slot such that the flange can be secured within the slot.

While this arrangement provides one solution to the rotation and restocking problems, it presents several other problems. For instance, the merchandisers each have a fixed size such that replacing an article with a larger article typically would require a different merchandiser. Thus, the existing merchandiser would have to be unloaded, removed and replaced by a larger merchandiser that could accommodate such a larger article. Of course, the same is true with smaller products.

Additionally, a bulky information compartment must be provided to cover the latch such that customers do not have ready access to the latch. This bulky information compartment typically is used to display produce pricing information and the like. However, due to the location of the information compartment, valuable shelf space is consumed by the shear size of the information compartment. This location is dictated, in part, by the location of the upwardly extending flange and, in part, by the need to cover the latch.

SUMMARY OF THE INVENTION

Accordingly, one feature of the present invention involves an adjustable snap-fit system. This aspect of the present invention allows the display assembly to be easily adjusted in a direction transverse to the direction of product removal, meaning the present display assembly easily adjusts to compliment containers and packaging having various widths.

Another feature of the present invention creates additional usable depth to the product shelving by moving the mounting location forward and compacting the front of the display assembly. For instance, in one arrangement, a single member forms a product information display, a forward abutment member and a receiving member for an upwardly extending flange.

A further feature of the present invention provides a stable connection to both the front and rear portions of the display assembly, such that the product tracks and any dividers disposed between the product tracks can be securely locked to the front and rear of the display assembly while still allowing the tracks and dividers to translate transverse to the front and rear of the display assembly.

Not all features need be implemented together in any single embodiment. For instance, only one feature may be implement in some arrangements while other arrangements exemplify all of the above-described features.

Accordingly, one aspect of the present invention involves an adjustable snap-fit display assembly for storing and displaying products in a shelf-like orientation. The display assembly comprises a frame having a front fence and a rear wall. The front fence and the rear wall are arranged generally parallel to each other and are separated from each other. The front fence and the rear wall comprise rails to allow attachment of an insertable component. The insertable component comprises a body that extends generally transverse to the front fence. The insertable component also comprises a slideable product pushing member that moves along the body and a biasing member that urges the product pushing member forward. The assembly further comprising clips that snap-fit onto the rails.

Another aspect of the present invention involves an adjustable display assembly that comprises a frame and a product supporting and feeding assembly. The frame comprises a front fence with the front fence comprising an upwardly extending rail. The product supporting and feeding assembly comprises a track. An end clip is connected to the track. The end clip secures the track to the rail. The rail is disposed rearward of a forwardmost portion of the front fence and forward of a generally vertical plane defined at a rearmost extent of the front fence.

A further aspect of the present invention involves an adjustable display assembly comprising a frame, at least two tracks and at least one divider. The frame comprises a front rail. The at least two tracks and the at least one divider each comprise an end clip that clips to the front rail. The at least two tracks and the at least one divider are separately removable from the frame without manipulation of the nonremoved components.

DESCRIPTION OF THE DRAWINGS

These and other features, aspects and advantages of the present invention will now be described with reference to the drawings of several preferred embodiments, which embodiments are intended to illustrate and not to limit the invention. The drawings comprise 10 figures.

DETAILED DESCRIPTION OF THE PREFERRED EMBODIMENT

Figure 1:
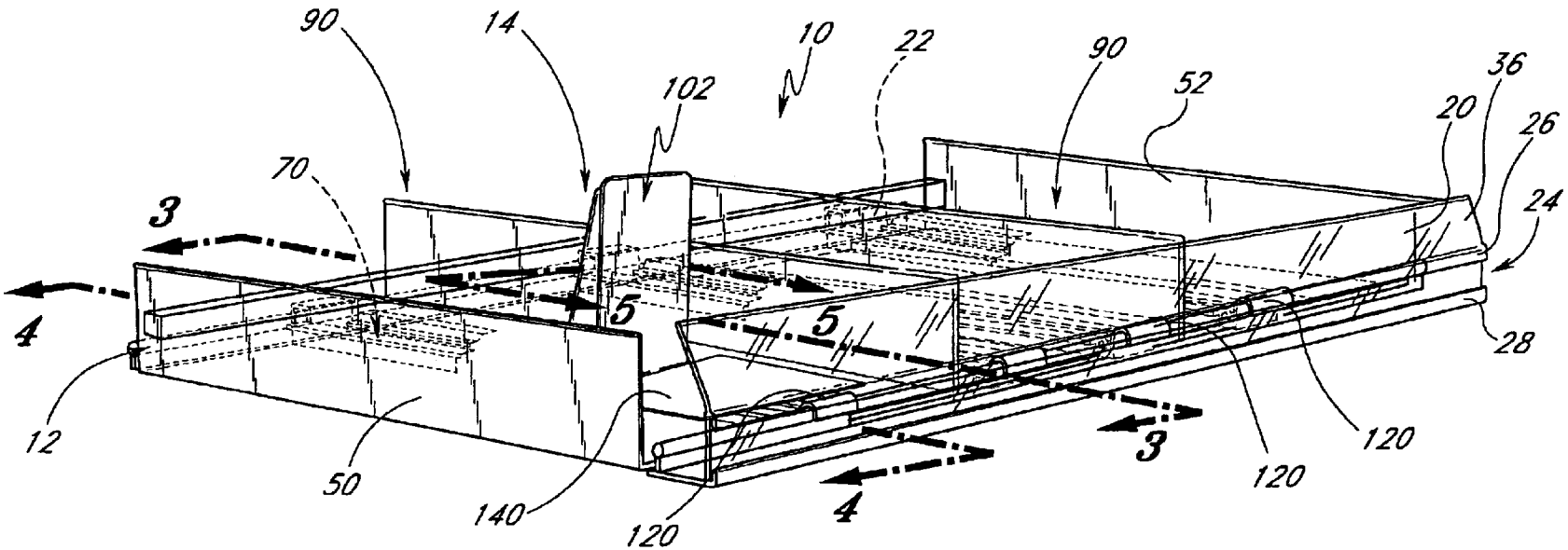
FIG. 1 is a perspective view of an adjustable display assembly having various features, aspects and advantages in accordance with the present invention.

With reference initially to FIG. 1, a snap-fit adjustable display assembly, generally designated by reference numeral 10, is illustrated therein. The illustrated assembly 10 typically is used with comestible products in various stores, such as grocery stores and convenience marts. Nevertheless, the display assembly 10 can be used in a variety of other environments, including but not limited to, warehouses, hospitals, drug stores, office supply rooms, auto parts stores and clothing stores.

With continued reference to FIG. 1, the present adjustable display assembly 10 generally comprises a frame 12 and a product supporting and feeding assembly 14. While the illustrated frame 12 can be placed directly upon a shelf or other similar structure, it also can be positioned within a slideable drawer (not shown) such that the drawer can be pulled out to provide access to the entire frame. A configuration employing a sliding drawer would be particularly advantageous where one display assembly 10 is oriented in close vertical relationship with another assembly 10. Mounting the assembly 10 within a drawer would ease product rotation by allowing a stock person access to substantially the full depth of the display assembly 10.

The Frame

With continued reference to FIG. 1, the frame 12 generally comprises a plurality of individually removable elements including a front fence 20 and a rear wall 22 configured to be placed on a shelf in front of and rearward of a product supporting and feeding assembly. The front fence 20 and the rear wall 22 extend generally parallel to one another with a desired spacing separating the two components 20,22. The components 20, 22 can be secured in this spaced relationship in any suitable manner.

Figure 3:
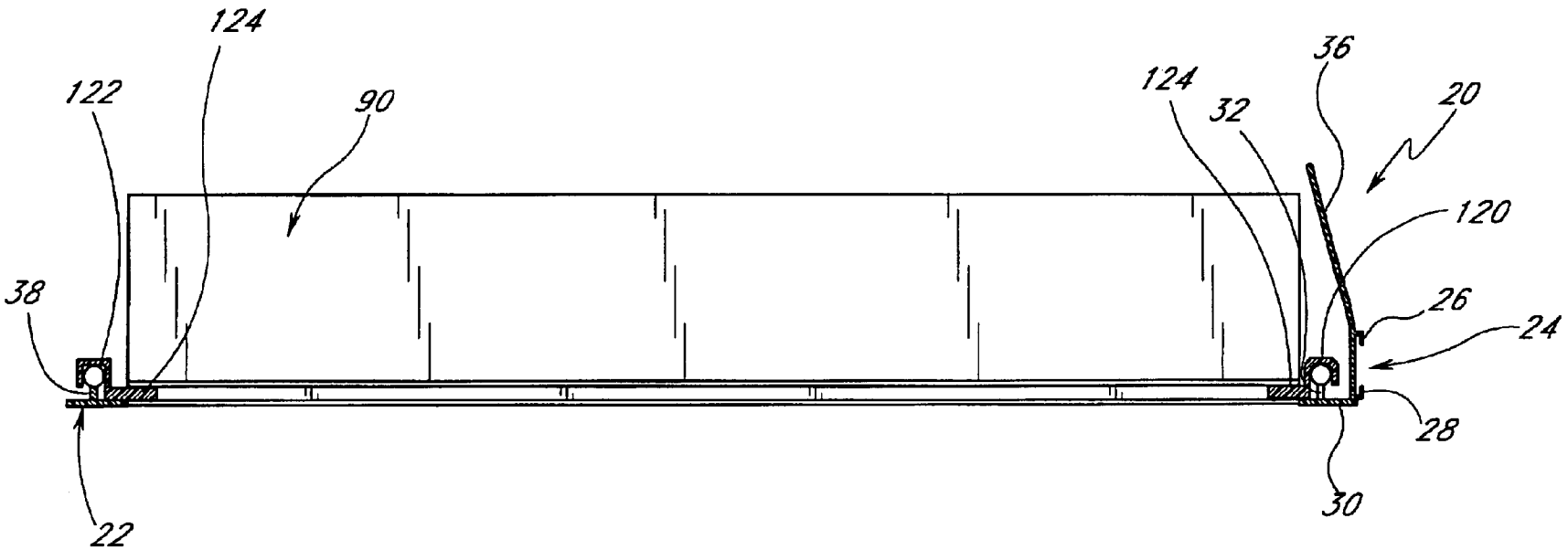
FIG. 3 is a sectioned view of the display assembly of FIG. 1 taken along the line 3—3 showing a divider with a front clip and a rear clip.
Figure 4:
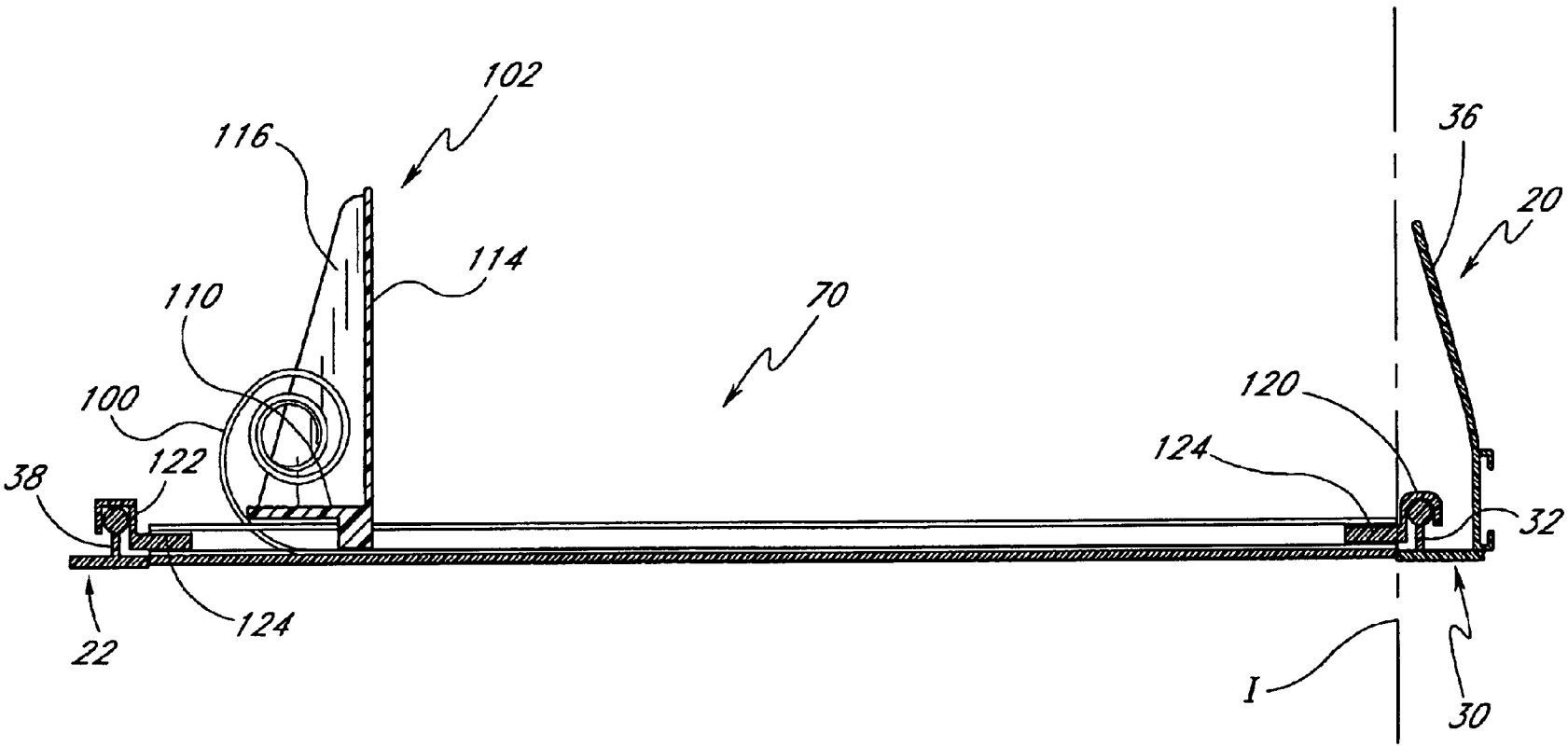
FIG. 4 is a sectioned view of the display assembly of FIG. 1 taken along the line 4–4 showing a track with a front clip and a rear clip.

With reference now to FIG. 3, the illustrated front fence 20 comprises a forward facing channel 24. An upper lip 26 and a lower 28 combine to define the channel 24. The channel 24 desirably is sized and configured to accommodate SKU identifiers, product identification components and/or pricing information (not shown) commonly positioned along the front of standard store shelving. The channel 24 can have any other suitable configuration and can be segmented or continuous along the transverse dimension of the display assembly 10.

The front fence 20 also comprises a rearward-extending flange 30. The flange 30 in the illustrated arrangement extends rearward at a lower extremity of the front fence 20. As such, the flange 30 provides a supporting surface for the front fence and, in some arrangements, the display assembly 10 in general. In the illustrated arrangement, an upwardly extending forward rail 32 is disposed along the flange 30 at a desired spacing from the front of the display assembly 10. The forward rail 32 preferably extends along the transverse direction of the display assembly in parallel to both the front fence 20 and the rear wall 22. In one arrangement, the forward rail 32 carries a cylindrical top portion and a flat lower portion. In another arrangement (see FIGS. 9 and 10), the forward rail 32 can be a flat component turned on end. Other suitable constructions also can be used.

Additionally, while the illustrated forward rail 32 extends substantially the entire length of the front fence 20, the forward rail 32 can be segmented or can extend along only desired portions of the front fence 20 in some arrangements. Advantageously, however, extending the forward rail 32 the entire length of the front fence 20 allows other components of the display assembly 10 to be attached at substantially any location along the length of the front fence 20.

With continued reference to FIG. 3, the front fence 20 comprises an upper portion 36 that retains product within the display assembly 10. Thus, the upper portion 36, in effect, forms an abutment member of the display assembly 10 that limits forward movement of product. In the illustrated arrangement, the upper portion 36 angles rearward from a location just above the upper lip 26. The rearward angle helps counter forward forces and better secures shelved products within the display assembly 10 while the shelved products are being urged forward in manners described below. Preferably, the angle also allows the front fence 20 to contact the product at a location in line with, or rearward of, the forward rail 32. In such a configuration, the forward rail 32 generally would not inhibit forward motion of the product.

The rear wall 22 can have any suitable configuration. In the illustrated arrangement, the rear wall 22 is a generally flat horizontal component with an upwardly extending rearward rail 38 As such, the illustrated rear wall 22 generally comprises the rail 38 and a lower support surface.

In some arrangements, the lower support surfaces defined at the front fence 20 and the rear wall 22 can receive a magnetized material, which forms an additional layer beneath the support surfaces. This additional layer may extend the entire transverse length of the front fence 20 and the rear wall 22 or may be segmented with smaller portions serving as feet for the adjustable display assembly 10. In some arrangements, the additional layers can be formed of rubberized components for shock absorption and the like, as well as Velcro or other suitable securing and supporting components.

With reference again to FIG. 1, the illustrated frame 12 also generally comprises a left end piece 50 and a right end piece 52 that are secured to the front fence 20 and the rear wall 22 in any suitable manner. The end pieces 50, 52 can be formed separate of other components of the display assembly 10 or can be formed as integral portions of the product supporting and feeding assembly 14, which will be discussed in detail below. The end pieces 50, 52 advantageously space the front fence 20 from the rear wall 22 and secure the components 20, 22 in relative relationship to each other. It is also anticipated that the frame can be formed from a single molded or otherwise manufactured component. In some constructions, the frame may be comprised of only a front fence 20 or a front fence 20 and a rear wall 22.

The Tracks and Dividers

With reference still to FIG. 1, the illustrated product supporting and feeding assembly 14 generally comprises a number of tracks 70 that are used to underlie the shelved products and a number of dividers 90 that are used to separate various queues of shelved products along the shelf face as desired. The tracks 70 and the dividers 90 preferably extend longitudinally between the front fence 20 and the rear wall 22. In addition, the tracks 70 and the dividers 90 are disposed laterally between the left end piece 50 and the right end piece 52. As will be discussed, in some instances, the product tracks 70 and the dividers 90 are integrally formed together (e.g., a divider and track are formed of a single piece—see FIG. 2) and in other instances, the product tracks 70 are separate from the dividers 90 to add increased flexibility to the sizing of the products which may be carried by the product tracks 70 between the dividers 90 (see FIGS. 2–7). Further details of additional arrangements that allow increased flexibility in sizing are disclosed in copending U.S. application Ser. No. 09/817,769, filed on Mar. 26, 2001, which is hereby incorporated by reference in its entirety.

Figure 2:
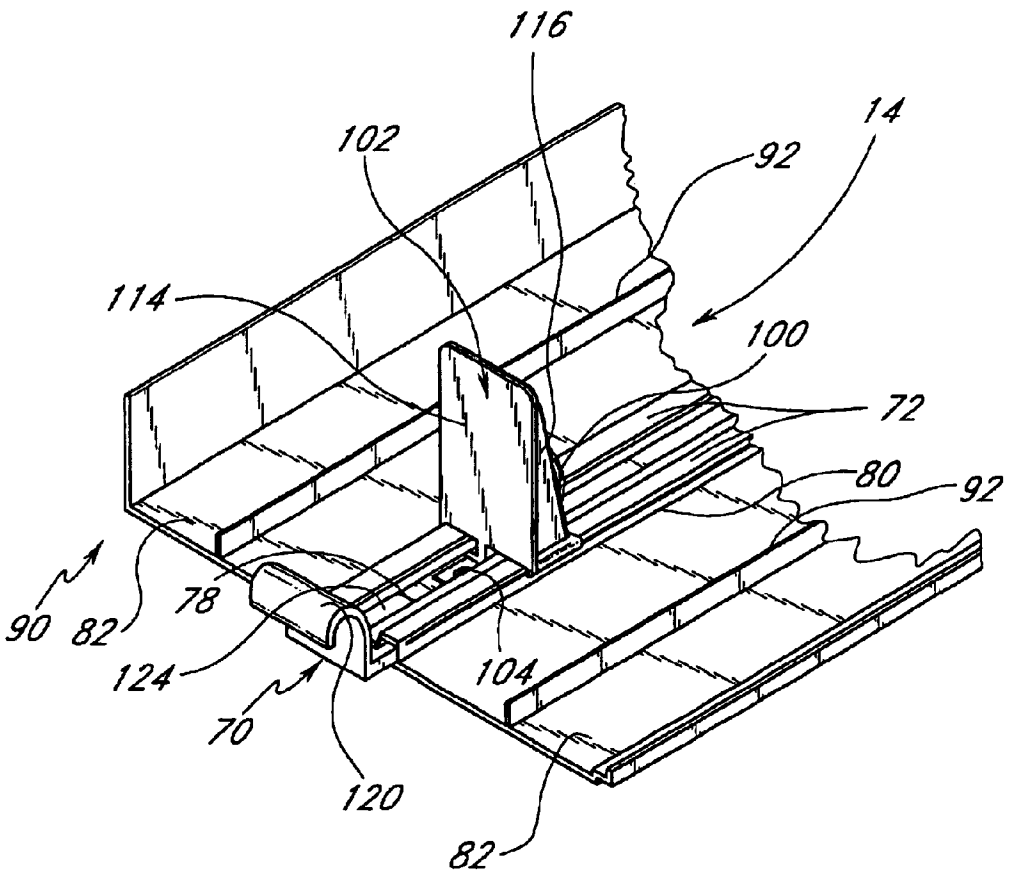
FIG. 2 is an enlarged perspective view of a combined track and divider arrangement that can be used in the adjustable display assembly of FIG. 1.
Figure 5:
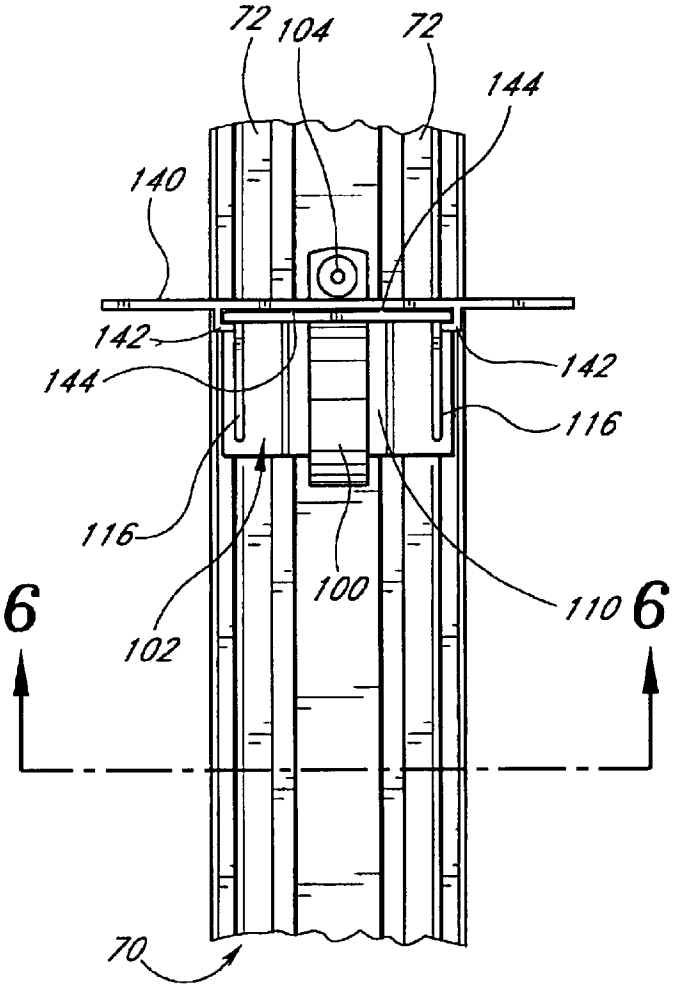
FIG. 5 is a top plan view of a portion of a track used in the display assembly of FIG. 1.
Figure 6:
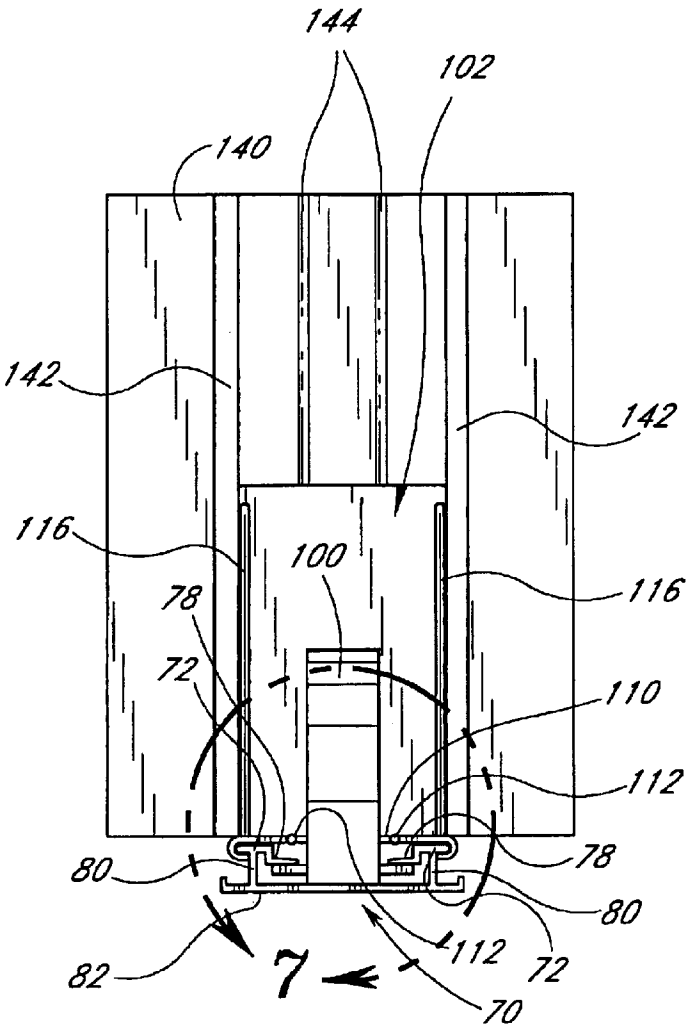
FIG. 6 is a sectioned rear view of the track of FIG. 5 taken along the line 6—6.
Figure 7:
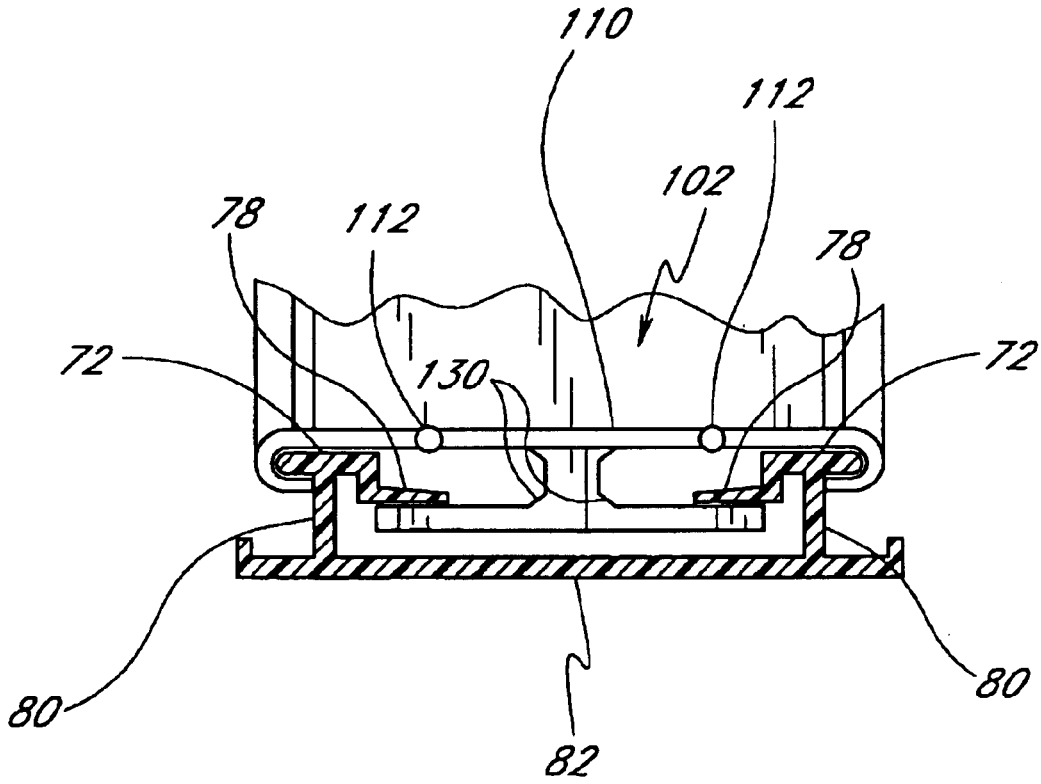
FIG. 7 is an enlarged portion of FIG. 6 taken along the line 7—7.
Figure 8:
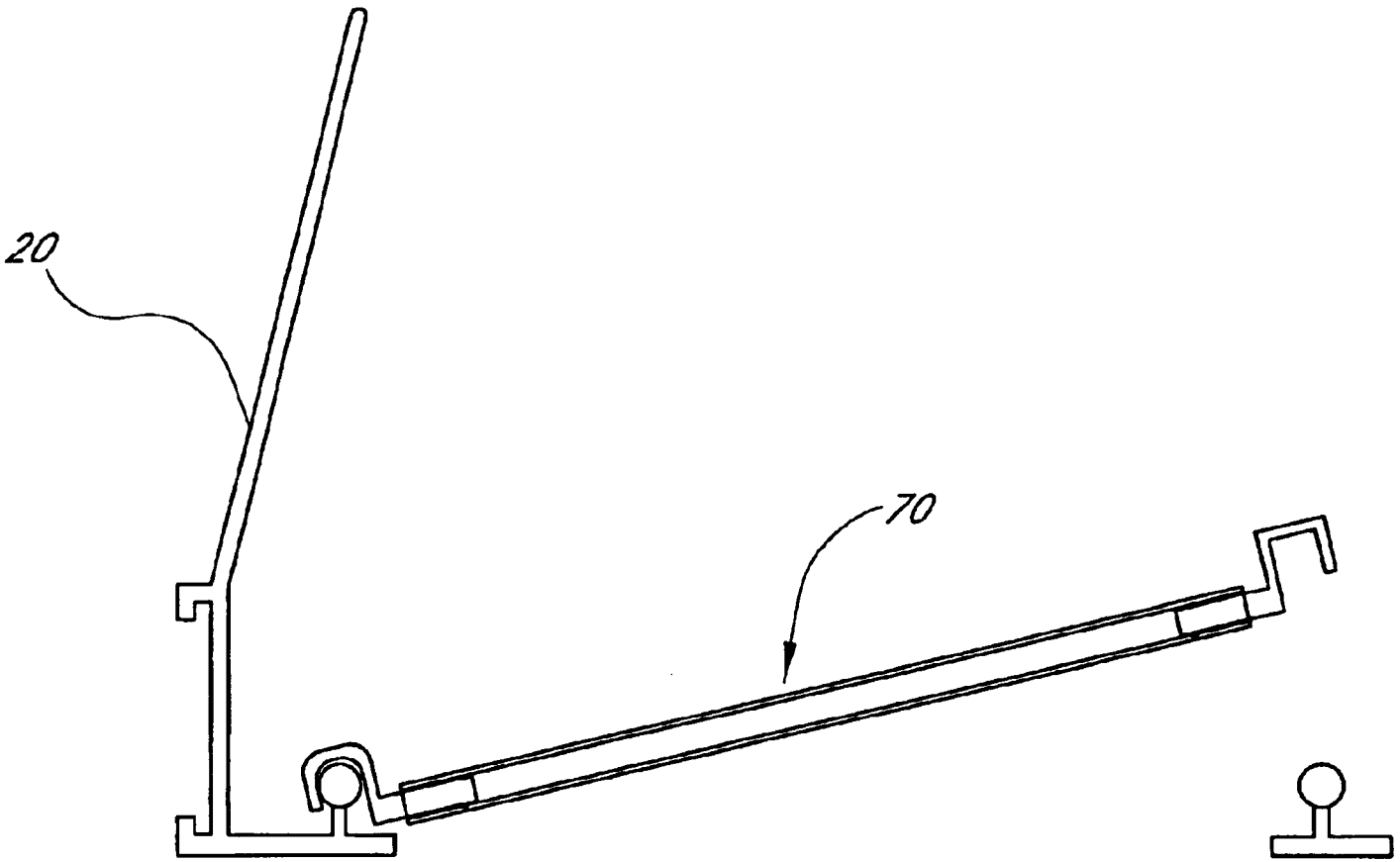
FIG. 8 is a schematic view showing a portion of the display assembly being snapped-in or snapped-out of position.

With reference now to FIGS. 5–7, one arrangement of the product track 70 is illustrated. The illustrated product track does not comprise an integrated divider, such a product track 70 and divider 90 combination is illustrated in FIG. 2. With reference still to FIG. 6, the illustrated product track 70 generally comprises a pair of rails or ridges 72 that are separated from each other and that extend in a collinear fashion substantially the depth of the display assembly 10. In other words, the rails 72 preferably extend substantially the full distance between the front fence 20 and the rear wall 22. Advantageously, in the illustrated arrangement, the rails 72 define a generally vertical plane upon which product that is being shelved can be supported.

With continued reference to FIG. 6, the illustrated rails 72 terminate at an inward edge with a sloping tie down surface 78. Preferably, the tie down surface 78 slopes downward and inward toward the center of the track 70. The tie down surface 78 cooperates with a product pushing member or product pushing member 102 (described below) that reciprocates along the length of the product track in manners which will be described. In one arrangement, the tie down surfaces 78 are vertically offset from the rails 72. Furthermore, in one particularly preferred arrangement, the lower surface of each tie down surface extends generally horizontally to achieve better interaction between the product pushing member and the track.

The track 70 further comprises a pair of generally vertically extending ribs 80. Each rib 80 spaces the rails 72 from a lower support surface 82. The rails 72, ribs 80 and lower support surfaces 82 create a double I cross-sectional shape in the illustrated arrangement. The lower support surface 82 preferably is continuous between the two sets of rails and ribs 72, 80. It should be understood that while the presently preferred product track 70 is a straight extrusion of the plastic material, it is envisioned that the rib or the lower support surface 82, may be intermittent along the length of the rails 72 such that the rib 80 or the lower support surface 82 is not continuous with the entire length of the rails 72.

With reference now to FIG. 1, two adjacent product tracks 70 preferably are separated by a dividing wall 90 such that movement of product carried by one product track 70 will not interfere with movement of product carried by an adjacent product track 70. The dividing wall 90 may take on any suitable configuration and, in arrangements such as the one illustrated in FIG. 2, can have the same general cross-sectional profile as a product track with the addition of an upward extending wall at one outer edge of the lower support surface 82. Advantageously, this illustrated arrangement also features at least one product supporting surface 92. The product supporting surfaces help support portions of the product that extend laterally away from the track 70. In some arrangements, the dividing wall 90 has a simple L-shaped configuration, while in other arrangements the dividing wall 90 has a simple T-shaped configuration. Other shapes also are practical. It also is possible to configure a dividing wall 90 without a product supporting surface 92.

The Forward Feeding Assembly

As discussed above, the illustrated display assembly 10 features a forward feeding assembly, which forms a portion of the product supporting and feeding assembly 14. In one particularly preferred arrangement, the forward feeding assembly comprises a biasing member 100 and a forwardly biased product pushing member 102. Preferably, the product pushing member maintains a sliding cooperation with the track. More preferably, the product pushing member 102 is in direct sliding connection with the product track 70. While arrangements such as those described in U.S. Pat. No. 5,111,942 may be suitable, the illustrated arrangement provides a simpler construction that is less expensive to manufacture and that is inherently more reliable.

With reference now to FIGS. 5–7, the biasing member 100 preferably is a roll spring. The roll spring 100 has characteristics which make it desirable over various other springs, such as compression springs. As is known, a roll spring naturally recoils after being extended and released, which recoiling involves rolling of the coil into its tightly wound initial state.

In some applications, coil springs may be used although they are not presently preferred . Moreover, elastic straps, ropes, and a variety of other springs and biasing members may be used depending upon the application. These other arrangements do not feature the simple elegance of the roll spring 100. As the roll spring 100 is stretched, the force exerted by the roll spring 100 varies unlike that of coil springs in which the force is approximately the same during such stretching.

Desirably, the free end of the roll spring is connected to at least one of the frame 12 and the track 70. As used herein, connected can be used to imply an intervening member, such that the free end of the roll spring 100 can be connected to the track 70 or frame 12 through another member that is, itself, connected or directly affixed to the track 70 or frame 12. In the illustrated arrangement, a rivet 104 is used to secure the spring 100 directly to the track 70. It is envisioned, however, that threaded fasteners, fasteners, pins, connectors and couplings of any suitable type may also be used. In other arrangements, the spring 100 can be attached to any mechanism by which the track 70 is secured to the frame 12, such as the clips, for example, that will be described below. Moreover, in some arrangements, the free end of the roll spring can be embedded in a portion of the frame or track. Thus, the free end of the roll spring 100 may be permanently, semi-permanently or removably attached to the product track 70.

The rolled portion of the roll spring 100 is simple to install. In the illustrated arrangement, the coiled portion of the roll spring 100 rests on a spring carrying surface 110 of the product pushing member 102. Due to the unique configuration of the roll spring 100, no permanent attachment or semi-permanent attachment is necessary to maintain the spring's position on the spring carrying surface 100. Indeed, the forward tension of the roll spring 100, which would be opposed by any product positioned forward of the product pushing member 102, would help to maintain the position of the roll spring 100 on the spring carrying surface 110. It should be noted here that the spring carrying surface 110 is delineated by a pair of raised ridges 112 (see FIG. 7) that are disposed on either side of the spring 100. These ridges 112 help to maintain the lateral position of the roll spring 100 relative to the product pushing member 102.

The product pushing member also comprises a forward face 114 (see FIG. 2) that contacts product to be urged forward within the display assembly 10. The forward face 114 is supported from the rear by a pair of gussets 116 (see FIGS. 2, 5 and 6) that angle upward from the spring carrying surface 110. The illustrated product pushing member also comprises a structure that results in a positive lock on the track 70. This structure generally comprises a pair of inwardly extending flanges and a T-shaped member that comprises a pair of outwardly extending flanges. These four flanges grip the track 70 at an outer location and at the tie-down surfaces 78 such that the product pushing member 102 is secured to the track 70 more securely. This construction is described in copending U.S. application Ser. No. 09/379,704, filed on Aug. 24, 1999, which is hereby incorporated by reference in its entirety.

End Clips

With reference initially to FIGS. 1–4 and 8–10, another aspect of the present display assembly 10 will be described. In particular, the present display assembly advantageously employs end-clips that allow easy insertion and removal of components, such as tracks 70 and dividers 90, while also allowing for some ability to translate these same components if needed. Thus, the illustrated arrangement features a snap-fit configuration vis-à-vis the frame 12.

With reference to FIGS. 1–4 and 8, a first configuration of the snap-fit end-clips is illustrated therein. In this arrangement, the end-clips are configured as hooks. In particular a front hook 120 is attached to a forward end of an insertable component, which will be used to generically reference to tracks 70, dividers 90 or other elements that are desirably insertable between the front fence 20 and the rear wall 22. Additionally, in the illustrated arrangement, a rear hook 122 also is attached to the insertable component. The use of a rear hook 122 greatly stabilizes the attachment of the insertable component and, in some applications, may not be used.

In the illustrated arrangement, the hooks 120, 122 define end caps and are used to attach the insertable component to the forward and rearward rails 32, 38. Preferably, the hooks 120, 122 are designed to allow sliding movement relative to the frame 12 after being snapped into position (e.g., see FIGS. 3 and 4). In some arrangements, the hooks 120, 122 are integrally formed with the insertable component.

Furthermore, the hooks 120, 122 can be configured such that one end of the insertable component has a more roundly configured hook which fits more tightly onto the associated rounded rail while the other end of the insertable component has a more squarely configured hook which fits less tightly onto associated rounded rail. The shapes of these components can be varied; however, the goal is to provide a tighter fit at one end of the insertable component. This allows for the attachment at one end, usually the more secure end, which is the forward end in the illustrated arrangement, and snapping of the other end on or off more easily. Thus, tolerance deviations can be better accommodated.

The hooks 120, 122 comprise a stem 124 that can be connect to the end of the insertable component. In some arrangements, the stem 124 is inserted into the end of the insertable component and friction fit into position. In other arrangements, the stem 124 can be secured, after insertion, with a fastening member, such as threaded fasteners, rivets, glue, clips or other physical interlocking configurations. In yet other arrangements, the stem 124 overlies or underlies a portion of the insertable component and is secured thereto in any suitable manner, including those expressed in the preceding sentence.

Figure 9:
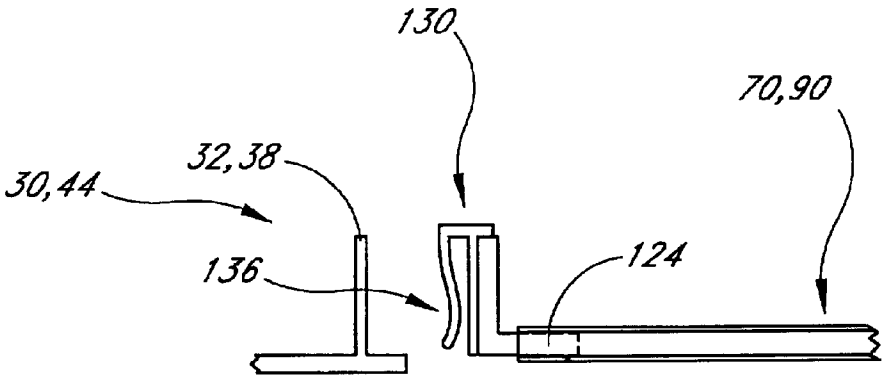
FIG. 9 is a side view of another clip construction.
Figure 10:
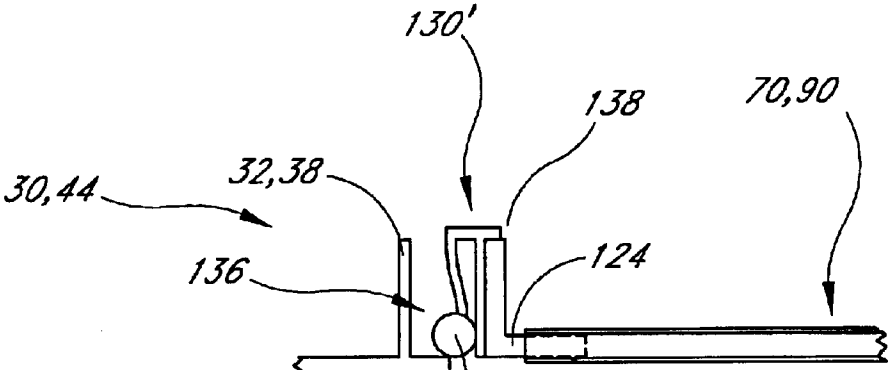
FIG. 10 is a side view of a further clip construction.

With reference to FIGS. 9 and 10, other clip-on configuration are illustrated therein. In these configuration, the front fence 20 and the rear wall 22 generally comprise a straight ridge 30 and 44. The insertable components comprise clips 130. The clips 130 can be the same regardless of the end with which the insertable component the clip is associated. Thus, manufacturing these constructions can be performed more efficiently and cost-effectively than the arrangement of FIGS. 1–8.

Preferably, when installed, the clips 130 extend slightly above the track but at a location that will not greatly inhibit forward movement of the product toward the front fence. Accordingly, in the illustrated arrangements, including the arrangement of FIGS. 1–8, the clip desirably is disposed just rearward of the front fence 20 but forward of the rearmost extremity of the upper portion 36 of the front fence 20. In this manner, the front fence 20 limits forward movement of the product without inhibition by the clips 130 or hooks 120, 122. In other words, the hooks and/or clips most preferably are installed between the front fence 20 and an imaginary vertical plane that extends at the rearmost extent of the upper portion 36 of the front fence 20. See FIGS. 3 and 4. In some arrangements, the vertical plane may intersect the hook and/or clips at a location at approximately the center of the rail 32; however, this location will more likely result in inhibited forward movement of boxed products.

With reference now to FIG. 9, the clip 130 is configured in a two-piece construction. Thus, in this arrangement, the lower portion 136 of the clip 130 that attaches to the associated rail is separately formed from the stem 124 and the two are secured together in any suitable manner. For instance, the two components can be welded, fused, adhered, cohered or mechanically secured together. It has been discovered, however, that this arrangement can result in premature failures due to the stresses placed upon the seam between the two pieces.

The portion of the clip 130 that attaches to the associated rail preferably comprises the lower gripping portion 136 and the upper portion 138 that receives the associated rail. A forward side of the gripping portion 136 recedes rearward and provides adequate pinching force to secure the clip 130 to the associated rail. Meanwhile, the upper portion supports the insertable member on the associated rail, in particular on the top of the associated rail, and allows the rail to translate if needed. In one arrangement, the clip 130 and the associated rail are formed of materials that reduce the friction and allow somewhat free translation. In another arrangement, the rail may be provided with intermittent ridges that lock the insertable member into certain positions. In yet another arrangement, the clip 130 and the associated rail can both have such ridges to increase the increments at which the two can be locked into position.

With reference now to FIG. 10, a further variation of the clip 130' is illustrated therein. Like components have been numbered with like reference numerals. The end clip features a cylinder 140 at the lower extremity of the lower portion 136 (i.e., one leg of the clip features the cylinder 140). The cylinder 140, with the clip 130' uninstalled, preferably contacts the other leg of the clip 130'. Once installed, this cylinder 140 applies the desired friction to secure the insertable component in position relative to the rails. In some applications, an upper end of the rails can be configured with a complementary structure that provides an interlock to reduce the likelihood of separation of the product supporting and feeding assembly 14 from the frame 12.

Accessories

Various accessories may be added to the adjustable display assembly 10 configured and arranged in accordance with the present invention. For instance, with reference to FIGS. 5 and 6, an increased size pushing paddle 140 is illustrated therein. The pushing paddle 140 increases the contact surface area between the product being moved forward and the product pushing member 102. Specifically, the paddle 140 is arranged with a pair of inwardly extending flanges 142 that are sized and configured to create a channel that slip fits over the forward face 114 of the product pushing member 102. Moreover, the paddle 140 comprises a pair of ridges 144 that decrease the contact area between the paddle 140 and the pushing surface 114 such that the paddle may be easily removed or positioned on the pushing surface 114 as desired. In some arrangements, the paddle 140 also can be used as a spacing member by lying flat along a forward portion of the track 70, as illustrated in FIG. 1.

Material Selection

Generally, the adjustable display assembly 10 may be comprised of any suitable material. Materials presently preferred are materials from the styrene family or self-lubricating FDA approved plastics, such as, but not limited to, acrylonitrile-butadiene-styrene (ABS). In some embodiments, however, the components may be manufactured from stainless steel, UHMW, or other FDA approved materials. The materials are chosen to allow for easy cleaning and reduce adsorption of liquids.

In applications not involving food products, the materials may be chosen from any material considered desirable. Where materials are not judiciously chosen to result in a self-lubricating nature to the product, materials such as brass or bronze or any other bearing type surface material may be utilized with steels and the like. Additionally, a silicon spray may be used to coat the surfaces to increase lubricity.

In some arrangements, the front fence 20 may be opaque, transparent or translucent. In the present and preferred embodiment, the front fence 20 is comprised of a clear plastic material to allow the prospective purchaser a clear line of vision to the product being carried by the adjustable display assembly 10.

Using the Display Assembly

In use, the display assembly is sized and configured using various product tracks 70 and dividers 90 to closely approximate the size of the packaging of the products being carried. It is anticipated that multiple product tracks 70 may be aligned side-by-side to carry heavier products such that a divider need not be placed directly between each and every product track 70. In some arrangements, the frame may be presized at a factory such that product tracks 70 and dividers 90 can be snapped into position. In addition, having been installed previously, tracks 70 and dividers 90 can be snapped out, repositioned, and snapped in. In some arrangements, one or more tracks 70 and/or dividers 90 can be removed while the remaining tracks and/or dividers in the display assembly 10 are translated with or without removal from the frame 12 to change the sizing of the display assembly 10 for use with differently sized products.

With the assembly complete, product may be loaded into the display assembly 10 by displacing the product pushing member 102 toward the rear wall 22 while stocking the product forward of the product pushing member 102. As products are removed from between the product pushing member 102 and the front fence 20, the product pushing member 102 will be urged forward under the bias of the roll spring 100 until the supply of product is depleted. When restocking, the product pushing member 102 simply can be slid rearward and the new product can be positioned rearward of the old product to ensure a continuous cycling of product.

The ability to slidably move the tracks and dividers, the ability to add and remove tracks and dividers, and the ease with which this is done, makes the display assembly 10 infinitely variable with respect to width of a product. It will be appreciated that the display assembly of the present invention is extremely versatile and can be constructed and configured to display products of varying size and configuration in side by side relation. In addition, the above-described constructions allow for maximized use of shelf depth by allowing product to forward-feed to the front fence 20.

Although the present invention has been described in terms of certain arrangements, other arrangements apparent to those of ordinary skill in the art also are within the scope of this invention. Thus, various changes and modifications may be made without departing from the spirit and scope of the invention. For instance, various components may be repositioned as desired. In addition, while different aspects of various arrangements have been described above, these aspects and arrangements can draw from each other such that one arrangement may employ an aspect of another arrangement. Moreover, not all of the features, aspects and advantages are necessarily required to practice the present invention. Accordingly, the scope of the present invention is intended to be defined only by the claims that follow.

What is claimed is:

1. An adjustable display assembly comprising a plurality of separable components configured to be individually placed on a shelf surface, the components comprising:

a longitudinal front fence configured to extend perpendicular to a plurality of product tracks, the front fence comprising:

a horizontal shelf-engaging flange;

a forward rail extending upwards from the shelf-engaging flange;

a front wall extending upwards from the shelf-engaging flange at a location forwards of the forward rail, the front wall corn rising an upper, rearwardly angled portion having an upper abutment surface configured to engage and retain a product;

wherein a rearward surface of the forward rail is positioned forwards of a vertical plane defined by a rearmost extent of the front wall;

at least one product track comprising:

a base member having a lower shelf-engaging surface;

a pair of raised slider rails extending longitudinally between a front end and a rear end of the base member; and a pusher member slidably mounted to the slider rails by at least one pair of flanges extending around portions of the slider rails, the pusher member being biased towards the front end of the slider rails;

a clip comprising:

a stem configured to be inserted into a space between a horizontal portion of the slider rails and the base member of the track; and a clip portion configured to pinch the raised rail to frictionally secure the product track to the forward rail.

2. The assembly of claim 1, wherein said rail does not comprise a rounded portion.

3. The assembly of claim 1, wherein said clip is a two-piece construction.

4. The assembly of claim 1, wherein said end clip is friction fit to said track.

5. The assembly of claim 1, wherein the shelf-engaging flange comprises a magnetic strip.

6. The assembly of claim 1, wherein the front fence is removably securable to a front portion of a shelf.

* * * * *

UNITED STATES PATENT AND TRADEMARK OFFICE

CERTIFICATE OF CORRECTION

PATENT NO. : 6,889,854 B2
APPLICATION NO. : 10/096223
DATED : May 10, 2005
INVENTOR(S) : Robert P. Burke It is certified that error appears in the above-identified patent and that said Letters Patent is hereby corrected as shown below:

In column 12, at line 3, delete “corn rising” and insert -- comprising --, therefor.

Signed and Sealed this

Eighteenth Day of July, 2006

JON W. DUDAS
*Director of the United States Patent and Trademark Office*